United States Patent [19]

Diggins

[11] Patent Number: 4,825,676

[45] Date of Patent: May 2, 1989

[54] FLANGE ROLLING TOOL

[76] Inventor: James R. Diggins, 37 West Common, Lindfield, Sussex, England, RH1 2AJ

[21] Appl. No.: 49,808

[22] Filed: May 12, 1987

[30] Foreign Application Priority Data

May 12, 1986 [GB] United Kingdom ..... 8611495

[51] Int. Cl.[4] ..... B21D 5/08

[52] U.S. Cl. ..... 72/211; 72/409

[58] Field of Search ..... 72/210, 211, 409

[56] References Cited

U.S. PATENT DOCUMENTS

| | | | |
|---|---|---|---|
| 837,783 | 12/1906 | Blumer | 72/211 |
| 2,434,401 | 1/1948 | Farnstrom | 72/211 |
| 2,471,445 | 5/1949 | Nicholas | 72/211 |
| 2,660,909 | 12/1953 | Morse et al. | 72/211 |
| 2,808,748 | 10/1957 | Bledsoe | 72/211 |
| 3,834,206 | 9/1974 | Lamontagne | 72/211 |
| 4,472,867 | 9/1984 | Wivinis | 72/211 X |

*Primary Examiner*—Robert L. Spruill
*Assistant Examiner*—Steven B. Katz
*Attorney, Agent, or Firm*—Browdy & Neimark

[57] ABSTRACT

A portable, hand-held tool for rolling a flange on metal sheet comprises a pair of handles pivoted together, the handles bearing a pair of parallel rollers which are moved together on approach of the handles and are drivable in rotation, the rollers having opposed portions of greater and lesser diameter so that on clamping of a metal sheet edge between the rollers and rotation of the rollers a flange is formed in the sheet edge. The handles may carry a device for setting the separation of the rollers at a desired value.

6 Claims, 2 Drawing Sheets

FLANGE ROLLING TOOL

FIELD OF INVENTION

This invention relates to a portable, hand-held tool for rolling a flange on a metal sheet.

PRIOR ART

In engineering workshops it is often desired to deform the edge of a metal sheet to provide a flange or edge portion which is offset from the plane of the sheet. This operation may be performed by passing the edge of the sheet between a pair of rollers acting on opposite sides of the sheet, the rollers being shaped to form the sheet edge to the desired shape. Existing rolling devices for this purpose are relatively massive bench-mounted machines which are not easily moved and the workpiece has to be manoeuvred into a position in which the edge of the sheet can pass between the rollers. This operation may be difficult or impracticable when the sheet to be deformed is large or of an awkward shape. For example in car body repair shops it is often desired to form a flange at the edge of a car body panel, such as the panel forming a wheel arch, and removal of the panel from the car body for this purpose is often difficult or impossible.

It is sometimes possible to deform the edge of a metal sheet to shape by pressing it between two flat dies of a crimping tool which is worked along the edge of the sheet, but such crimping tools are generally incapable of producing a smooth, continuous flange at the edge of the metal sheet.

SUMMARY OF INVENTION

The present invention is intended to provide a portable tool for forming such a flange which is easy to use and can provide a smooth, uniform flange along the edge of a large metal sheet in situ. The tool may be used with metal sheets of any size and shape.

According to one aspect of the invention, there is provided a portable flange rolling tool comprising a pair of handles pivoted together for relative rotation about the pivot axis, the handles being adapted to be grasped and urged together by one hand, a pair of rollers each mounted on a respective handle and rotatable about parallel axes, the rollers having adjacent peripheral surfaces separated by a gap, the width of the gap being variable by relative rotation of the handles about the pivot axis so that the edge of a metal sheet may be inserted and clamped between the rollers, the surfaces of both rollers having portions of greater and lesser diameter, the portion of greater diameter of one roller opposing the portion of lesser diameter of the other roller, and the respective portions of greater diameter overlapping each other in the radial direction of the rollers when the rollers are brought together so that on passage of an edge of a metal sheet between the rollers the sheet is deformed to from a step therein, and means for driving the rollers simultaneously in opposite directions about their respective axes.

In a preferred embodiment, the rollers are drivable in rotation by intermeshing gears integral with the rollers, a driving gear is mounted on one of the handles intermeshing with one of the gears of the rollers and means are provided for rotating the driving gear to drive the rollers in rotation. The driving gear may be rotated by means of a driving head such as a hexagon head attached to or integral with the driving gear, the head being rotatable manually by a spanner or power driven by a pneumatic or electric motor.

The rollers may be mounted to rotate about parallel spindles which are integral with or rigidly attached to the respective handles.

Preferably, the tool is provided with setting means for setting the handles to a desired relative position so that the gap between the rollers is set at a desired value. The setting means may comprise an externally threaded screw passing through and engaging an internally threaded aperture in one of the handles, the screw extending towards the other handle and its end abutting said other handle when the handles are urged together. The other end of the screw may have an abutment surface which engages a toggle lever attached to a rod connected to said other handle, the toggle lever engaging the abutment surface to lock the handles at a separation defined by the position of the screw.

DESCRIPTION OF DRAWINGS

A flange rolling tool according to one embodiment of the invention will now be described by way of example with reference to the accompanying drawings in which.

DESCRIPTION OF PREFERRED EMBODIMENT

Figure 1:
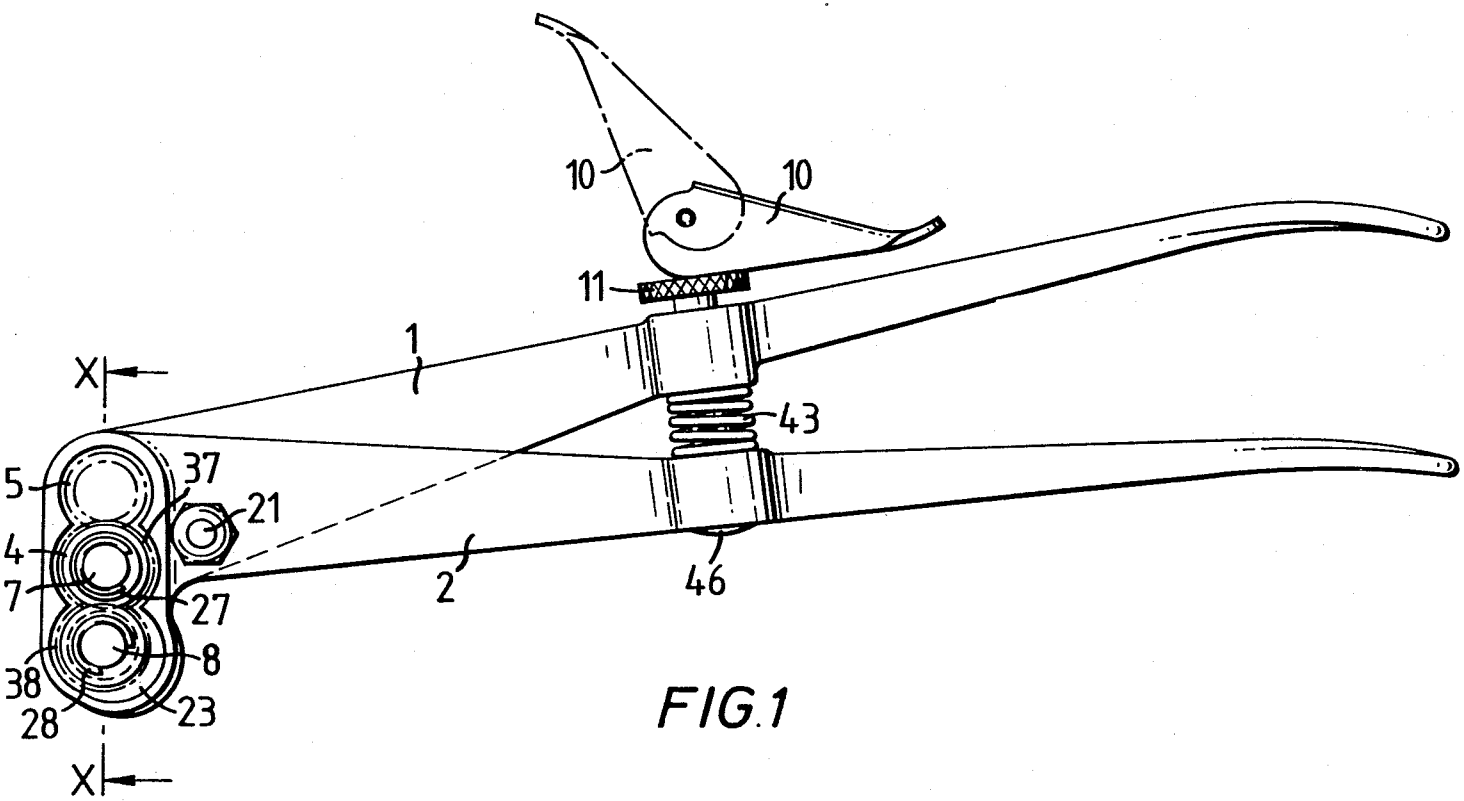
FIG. 1 is a elevation of the flange rolling tool.

The tool shown in the Figures comprises a pair of handles 1, 2 consisting of steel forgings which are pivoted together by bolt 21 passing through holes in the forgings and secured by nut 22. The handles are dimensioned and shaped so that both their free ends are easily grasped in one hand and pressed together by an operator. The end of handle 2 adjacent the pivot is rigidly attached to a spindle 7 which projects outwardly parallel to the axis of the pivot and handle 1 is rigidly attached to spindle 8 which similarly projects outwardly, parallel to and beside spindle 7; spindle 8 passes through a hole 23 in handle 2 and a nut 24 securing spindle 7 to handle 2 is located in a hole in handle 1. The spindles and holes are arranged so that as handles 1 and 2 pivot relatively to each other about bolt 21 the distance separating spindles 7 and 8 in their radial direction is varied.

Spindles 7 and 8 are provided with respective rollers 4 and 3 which are rotatable about the spindles and retained on their spindles by circlips 27, 28 engaging grooves in the spindles. The ends of the rollers adjacent the handles are integral with intermeshing gear wheels 37, 38 located in respective recesses in handle 2 so that the rollers rotate together in opposite directions.

Handle 2 also carries a drive gear wheel 5, located in a recess in handle 2, which meshes with gear wheel 37. Gear wheel 5 is mounted in bearing 6 and has an axis 15 extending through a hole in handle 1 and attached by means of a grub screw to a hexagonal driving head 9. Head 9 may be rotated manually by means of a spanner or socket wrench to rotate gear wheel 5 and hence rotate rollers 3 and 4. Alternatively, driving head 9 may be rotated using a pneumatic or electric motor.

Rollers 3 and 4 both have cylindrical outer surface portions of greater and lesser diameter and are arranged so that, when the handles 1 and 2 are "closed", that is they are relatively close together so that rollers 3 and 4 are relatively close, the portions of greater diameter overlap each other in the radial direction of the rollers.

However, these portions do not overlap when the handles are "open", that is separated by a relatively large distance. Thus, when the handles are open the tool may be positioned so that the edge of a metal sheet is located between the rollers and, when the handles are closed so that the roller portions of greater diameter overlap, the metal edge is deformed to form a step or flange in the edge. With the tool in this attitude, when the driving head 9 is rotated the rollers also rotate and the tool is moved along the metal edge to form a continuous flange of constant width and depth. During this operation the handles are conveniently held with one hand and the head 9 may be rotated using the other hand.

In the device shown in the drawings the spindles 7 and 8 are relatively massive and firmly attached to the handles so that they are not splayed out by the force exerted by the metal sheet on the rollers during deformation. However the diameters of the outer surfaces of the rollers are relatively small so that the tool is easily manoeuvred along a non-linear metal edge, which may have curves of relatively small radius.

The rollers are retained on their spindles by circlips 27, 28 and may easily be removed, together with their integral gears from their spindles by removing the circlips. This feature allows the rollers to be interchanged in order to alter the side of the sheet on which the flange is located. In the tool shown in the drawings the roller portions are cylindrical so that the plane of the flange formed is parallel to the plane of the metal sheet. Alternatively the roller portions may be of different shapes to provide different sections, the opposed portions of the rollers still being complementary to each other. For example the rollers may be frusto-conical to provide an edge flange which is oblique to the plane of the sheet.

When the tool is used it is very desirable that the gap between the rollers should be constant as the rollers move along the sheet edge, as otherwise the magnitude of the step formed between the sheet and the flange will vary; also when the sheet is of soft metal such as aluminium the sheet may become thinned if the rollers are held too closely together. The tool shown in the drawings has a setting device whereby the rollers may be set at the desired separation when the sheet is first clamped between them and this separation is then held constant as the tool moves along the sheet edge.

Figure 2:
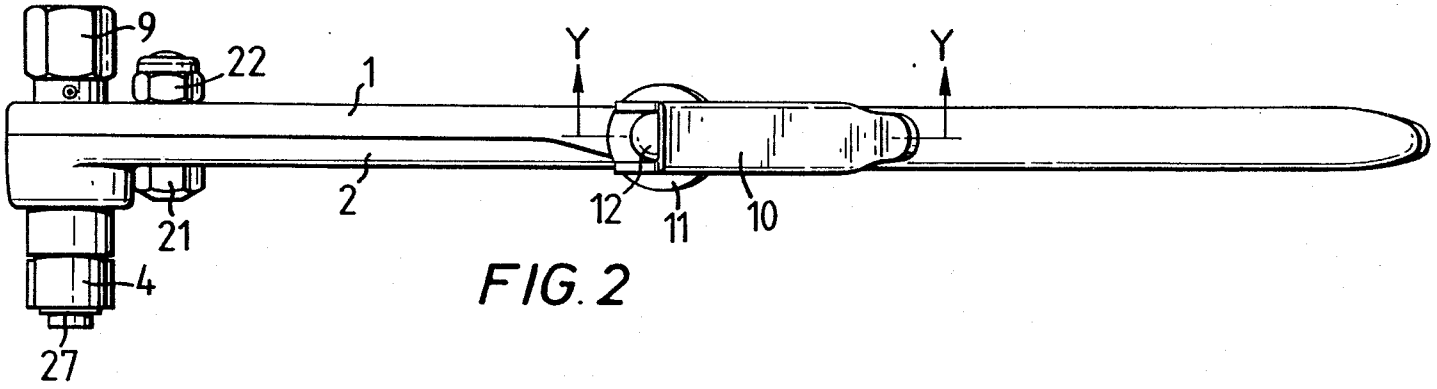
FIG. 2 is a view of the tool of FIG. 1 from above.
Figure 4:
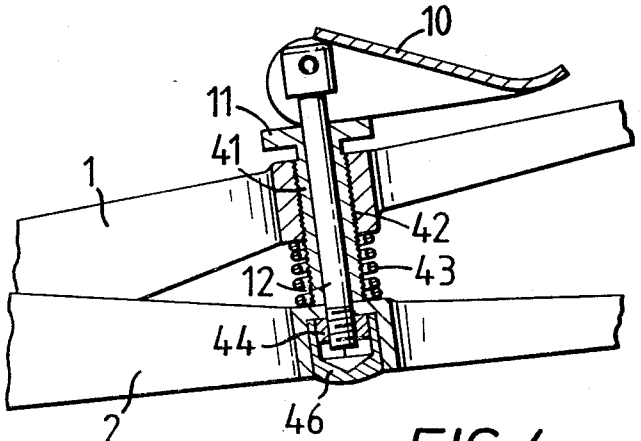
FIG. 4 is a cross-section along y-y of FIG. 2.
Figure 3:
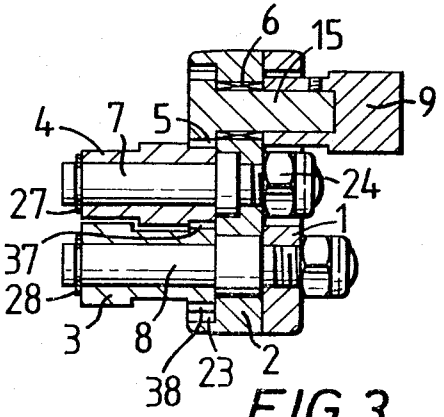
FIG. 3 is a cross-section along x-x of FIG. 1.

This setting device is shown in FIGS. 1, 2 and 4. It comprises a screw 41 engaged in an internally threaded aperture 42 in handle 1 terminating at one end in a flat-topped disc 11 having a knurled edge allowing the screw to be turned easily. The other end of the screw projecting beyond handle 1 abuts handle 2 when the handles are urged together and prevents the handles moving further together, thus defining the minimum possible gap between the rollers. Rotation of disc 11 causes advance and withdrawal of the screw 41 in aperture 42, allowing this minimum gap to be varied. The handles are urged apart by a compression spring 43 which surrounds the screw 41.

A clamping bolt 12 passes through a bore in screw 41 and is attached to handle 2 by means of a hexagon nut 44 screwed on to one end, the nut being located in an aperture in handle 2 and abutting a shoulder 45 of the aperture which prevents withdrawal of the screw. Nut 44 is surrounded by a hexagonal socket 46 which is rigidly fixed in the aperture and prevents rotation of nut 44 and bolt 12. However the bolt can move relative to handle 2 to a limited extent in the longitudinal direction of the bolt. A toggle lever 10 is pivoted to the other end of the bolt and forms an eccentric having a surface which abuts the surface of disc 11.

When the toggle lever 10 is in its "open" position shown in broken lines in FIG. 1 handle 1 can move relative to handle 2 between a closed position in which screw 41 abuts handle 2 and an open position in which handle 1 is separated from handle 2 by a greater distance. When toggle lever 10 is moved to its closed position, shown in solid lines in FIGS. 1 and 4, its abutment surface bears on disc 11 and urges handle 1 to its closed position, thus clamping handles 1 and 2 in their position of minimum separation which is defined by screw 41. When the tool is applied to a metal sheet the toggle lever 10 may be in its open position, with the handles open to their maximum extent, and the tool placed with the sheet edge between the rollers. The handles may then be pressed together by one hand and screw 41 rotated, its end abutting handle 2, to reach the desired gap between the rollers. The toggle lever is then moved to its closed position. The rollers are thus held at a constant separation while head 9 is rotated and the tool moved along the sheet edge to form a flange.

In an alternative embodiment, not shown in the drawings, a pneumatic motor is attached to one of the handles and arranged to drive gear 5 in rotation, the operation of the motor being controlled by a suitably located button. This arrangement allows the tool to be self-powered and operated entirely with one hand.

I claim:

1. A portable flange rolling tool comprising a pair of handles pivoted together for relative rotation, a pair of rollers each mounted on a respective handle and rotatable, about axes parallel to said pivot axis, on parallel spindles which are rigidly attached to the respective handles, the rollers having adjacent peripheral surfaces separated by a gap, the width of the gap being variable by relative rotation of the handles about the pivot axis so that the edge of a metal sheet may be clamped between the rollers, the surfaces of both rollers having portions of greater and lesser diameter, the portion of greater diameter of one roller opposing the portion of lesser diameter of the other roller and the respective portions of greater diameter overlapping each other in the radial direction of the rollers when a metal sheet is clamped between the rollers and the rollers moved towards each other, so that, on passage of an edge of a metal sheet between the rollers, the sheet is deformed by the rollers to form a step, and means for driving the rollers simultaneously in opposite directions about their respective axes, said means for driving the rollers comprising a gear on each roller, these gears meshing with one another and said driving means further comprising a driving gear mounted on one of the handles intermeshing with one of the gears on the rollers, and there being means for rotating the driving gear to rotate the rollers.

2. A tool according to claim 1, in which the means for rotating the driving gear wheel comprises a hexagon head attached to the driving gear and capable of being rotated by a spanner.

3. A tool according to claim 1, having setting means for setting the handles to a desired relative position to set the gap between the rollers at a desired value.

4. A tool according to claim 3, in which the setting means comprises an externally threaded rotatable screw passing through and engaging an internally threaded aperture in one of the handles, the screw extending towards the other handle and an end of the screw abutting said other handle when the handles are urged together.

5. A tool according to claim 4, in which the end of said screw remote from said other handle has an abutment surface and said other handle is attached to a rod which passes through said one handle, and a toggle lever is pivoted to said rod, the toggle lever having a surface which abuts said abutment surface of the screw on rotation of the toggle lever about the rod to lock the handles in said desired relative position.

6. A tool according to claim 3, comprising a compression spring for urging the handles apart.

* * * * *